US006315570B1

(12) United States Patent
Mathes

(10) Patent No.: US 6,315,570 B1
(45) Date of Patent: Nov. 13, 2001

(54) METHOD OF PLAYING A GAME TESTING COMMUNICATIVE SKILLS

(76) Inventor: Beth A. Mathes, 1637 Rainbow Rd., Elkhart, IN (US) 46514

( * ) Notice: Subject to any disclaimer, the term of this patent is extended or adjusted under 35 U.S.C. 154(b) by 0 days.

(21) Appl. No.: 09/419,297

(22) Filed: Oct. 15, 1999

(51) Int. Cl.[7] ..... G09B 19/00
(52) U.S. Cl. ..... 434/237; 273/459
(58) Field of Search ..... 273/429, 430, 273/445, 459; 434/236, 237, 167

(56) References Cited

U.S. PATENT DOCUMENTS 2,454,478 * 11/1948 Roberts ..... 273/445
3,768,176 * 10/1973 Huddleston ..... 273/459
3,953,027 * 4/1976 Katzman et al. ..... 273/459
4,474,371 * 10/1984 Sibermintz ..... 273/429
4,763,898 * 8/1988 Hemmann ..... 273/445
5,094,465 * 3/1992 Dawson ..... 273/429

* cited by examiner

*Primary Examiner*—Sam Rimell
(74) *Attorney, Agent, or Firm*—Walter D. Ames

(57) ABSTRACT

A method of playing a game in which one constructor player assembles a group of variously shaped blocks into a construct and other players attempt to duplicate the construct only through verbal directions from the constructor player.

7 Claims, 2 Drawing Sheets

METHOD OF PLAYING A GAME TESTING COMMUNICATIVE SKILLS

FIELD OF THE INVENTION

The present invention relates generally to the field of games. More specifically, it pertains to games that test the skills of the players, in this case the communicative skills of one of the players and the cognitive abilities of other players.

BACKGROUND OF THE INVENTION

Parlor games that test the ability of a person to communicate a concept, title, or phrase to another have a lengthy history. As an example, in the game of Charades, one person conveys a name, title, saying, or almost any other concept by acting out the idea. Thus, the idea is communicated by physical means without verbal communication to the recipient, either in written or oral form. In this manner a concept manifests itself by physical movements alone, and the object of the game is for the recipient to express in verbal form that which has been communicated by optical sensations alone, normally much to the delight of the participants.

According to the present invention, physical manifestations, such as random structures, are conveyed from one participant to another by verbal descriptions, in a manner that might be deemed the reverse of a game of Charades. Yet while the game toward which my invention is directed is well suited to be played as a parlor game, in which competitive teams attempt to duplicate precisely a structure or concept created by one player and communicated orally to another without the benefit of sight, it is also adapted to be used as a teaching tool. Indeed, the ability of a person to communicate the identity of a construct to another person is sharpened, as is the recipient's ability to receive and understand such communications. For example, communicative and cognitive skills may be measured by timing the ability of a team of constructor/communicator—recipient/reconstructor to complete a complex, individualized structure of which the recipient/reconstructor has no knowledge other than a verbal description by the communicator/constructor.

Thus, it is a primary object of the present invention to provide a communication game in which the communicator conveys a construct by verbal means only, and the recipient receives such information only in verbal form without the benefit of being able to use any other of his or her senses.

It is a further object of my invention to provide a parlor game in which one player reproduces a structure built or being built by another using an oral description provided by the builder without being afforded visual access to that structure.

SUMMARY OF THE INVENTION

In its more general form, the present invention relates to a method of playing a game in which communicative and cognitive skills are tested. The game is played by at least two players, and begins with the step of locating those players so that none can see the acts of one who is designated as the communicator/constructor, but each is in audible communication with the other. Each player is provided with the same group of objects. One of the players—the communicator/constructor—performs one or more acts of arranging the objects with respect to each other, and that constructor player then communicates a synopsis of his acts to the other players, who attempt to duplicate his arrangement. If he has not completed his construct, the communicator continues to perform acts of arranging the objects, and the other players attempt to duplicate that arrangement by oral communication only from the constructor/communicator. Finally, the object arrangements of the communicator/constructor and the recipient/reconstructors, if there are more than one of the latter, are compared to see how well the constructs of the communicator and recipients match.

In a preferred embodiment, my invention pertains to a method of playing a game for testing communicative and cognitive skills of the players wherein there are two players: the communicator/constructor and the recipient/reconstructor. Where there are such two players, the players may be physically positioned so that they are back-to-back and the recipient player is forbidden from turning and viewing the construct: of the communicator/constructor player.

With respect to the construct, itself, in one simplified example the construct is formed from blocks, which may be wooden, and are of varying shapes, e.g., they may be hexahedrons, cylinders, tetrahedrons, semi-cylinders, and the like, and in cross-section may be triangular, circular, square, rectangular, rectangular with an arcuate portion cut therefrom, and other shapes which will vary in accordance with the complexity of the final construct. Further, the blocks may also be of different colors, which thus greatly simplifies the ability of the communicator to tell the recipient what block is being referenced. It will be apparent that the greater the variety of colors that are used, the more simple it becomes for the communicator to direct the recipient to any particular construct element.

These and other objects, features and advantages of my invention will become more apparent when considered in conjunction with a detailed description of a preferred embodiment of my invention as described hereinafter and as illustrated with a drawing of that preferred embodiment in which:

DETAILED DESCRIPTION OF THE INVENTION

Figure 1:
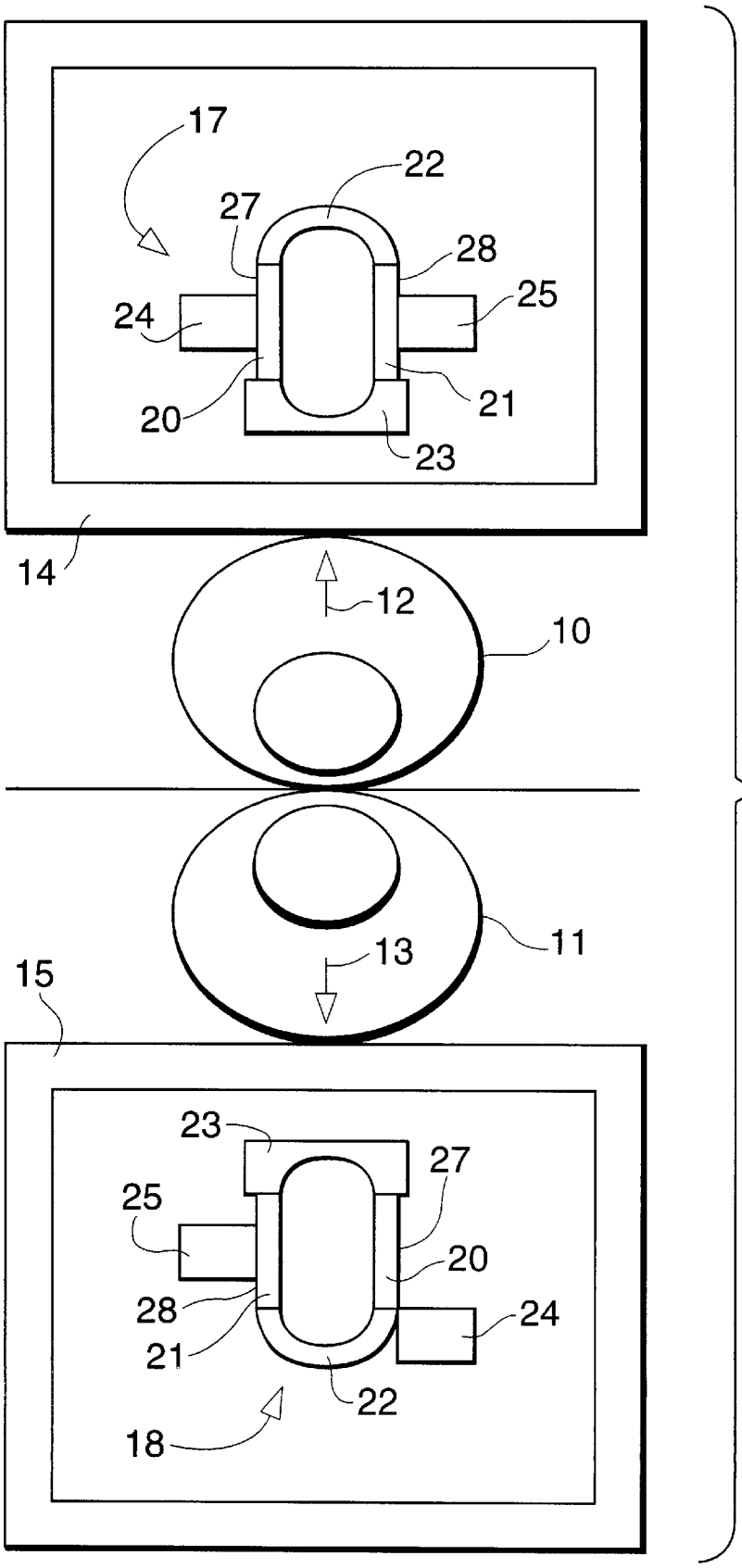
FIG. 1 is a diagrammatic, top plan view of two players engaged in playing the game of my invention.

As seen in FIG. 1, two players are there diagrammatically illustrated as engaged in carrying out the method of the game. The communicator/constructor 10 and the recipient/reconstructor 11 are seated back-to-back, facing in the directions of the arrows 12 and 13, respectively. Thus, neither is able to see the other's construction. Each player is provided with a rigid board on which his construct can be erected, player 10 utilizing board 14 and player 11 using board 15.

In this best mode of my invention, player 10, the constructor/communicator, has at least partially erected a structure 17. Player 11, the recipient/reconstructor, is attempting to duplicate that structure with his structure 18.

In structure 17 an example is shown in which, in top plan view, player 10 has formed a structure in which two relatively narrow rectilinear blocks 20 and 21 have their respective free ends contacted by a semicircular block 22 at the end farthest from the player 10 and by a rectangular block 23 at the end nearest that player, block 23 having an arcuate portion excised therefrom. A pair of blocks 24 and 25, which are square in plan view, are juxtaposed to outwardly facing walls 27 and 28 of blocks 24 and 25, respectively, midway between the ends of those blocks.

Also illustrated in FIG. 1 is the structure 18 erected by the recipient/reconstructor 11 on his board 15. That structure correctly duplicates structure 17 of the communicator/constructor 10 with an exception. So, the structure is shown as duplicated with blocks 20' and 21' spaced from each other by blocks 22' and 23' positioned at the far and near ends of the blocks 20' and 21'. However, it will be apparent that while blocks 24' and 25' are contiguous with outer walls 27' and 28' of blocks 20' and 21', blocks 24' and 25' are not located equidistant from the ends of those walls, as are blocks 24 and 25. Thus, construct 17 of the communicator/constructor 10 has not been duplicated precisely by the construct 18 of the recipient/reconstructor 11.

Figure 2:
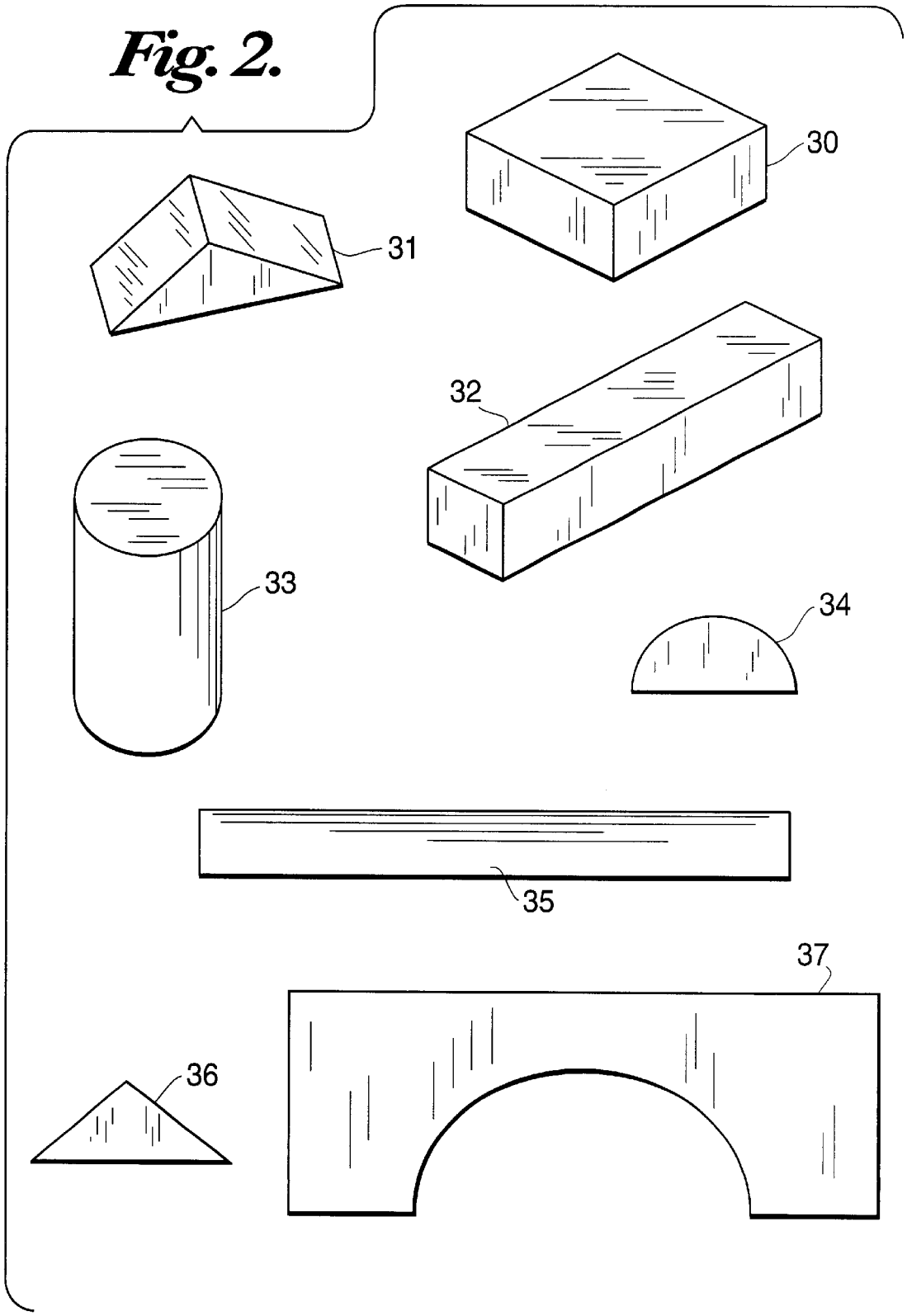
FIG. 2 is a view of a group of various blocks, some shown in perspective and some in elevation, which blocks are preferably used in playing the game.

Shown in FIG. 2 of the drawings is a group of blocks that may be used to devise a construct that will then be communicated by player 10 to player 11, either after it has been built or during its construction. For the purposes of the present invention the structure to be created may utilize a variety of blocks. For the purposes of illustration only, what is shown in FIG. 2 is a hexahedron 30, which is square in plan view, and a pentahedron 31, which is triangular in vertical cross-section. Also shown is a hexahedron 32, which has a length that is approximately three times its height and width. Also, there is a relatively short cylinder 33, a block 34 that is semicircular in horizontal cross-section, an elongated cylinder 35, and a pentahedron 36 that in horizontal cross-section is in the form of an equilateral triangle. Rectangular block 37 is in the form of a rectangular hexahedron from which a portion that is semicircular in plan view has been removed.

However, as emphasized herein, the specific dimensions of any block are not of great importance to the present invention, merely the fact that there are blocks that will form a structure to be communicated by one player, the communicator/constructor, to another player, the recipient/reconstructor, who will base his structure only on the oral communications from the communicator/constructor to him.

In actual practice, as I presently contemplate my preferred embodiment, the two players are seated back-to-back, each with his playing board 14 or 15 and the same group of blocks before him. The communicator/constructor 10 begins to build a structure such as that toward which arrow 17 is directed. As he forms his construction, the constructor 10 orally informs his back-to-back partner what he is doing, that is, exactly how he is positioning each piece. Following those instructions, the other game player attempts to construct a structure solely in accordance with the oral directions of his partner. The recipient/reconstructor cannot turn and view the structure that is being constructed by his partner, in order to ascertain whether the structure that the recipient/reconstructor is building is in conformity with that of the communicator/constructor. Indeed, in my best mode, he cannot ask questions of the communicator/constructor, although in a variation of the game he may be permitted to ask such questions. However, in my most preferred embodiment it is believed more of a test of communicative skills for the communicator/constructor to convey orally that which he is building to the recipient/reconstructor without having a further opportunity to clarify his instructions in response to interrogatories propounded by the respondent/reconstructor. Thus, in my presently preferred embodiment, the communicator/constructor builds his structure, telling his back-to-back partner what he is doing and it is up to that recipient/reconstructor to replicate or attempt to replicate the structure being built by the communicator/constructor without being able to extract further information from him.

As presently conceived as my preferred embodiment, the blocks that are utilized to make a structure are formed from wood and are solid, so that they will have enough substance to enable a fairly complex structure to be erected. Further, the blocks are not necessarily those that are shown as part of the structure and, indeed, some blocks of different shapes are illustrated in the sole figure of the drawing. Thus, another pentahedron is shown which block, in vertical section, is in the form of an isosceles triangle. Obviously, a block which in cross-section is in the form of an equilateral triangle would be equally representative of wooden blocks according to the present invention. Additional shapes exemplified by blocks 22, 23 and 24 are equally applicable for use in building a structure.

Moreover, all or certain of the blocks can be colored by having one or more of their outside surfaces painted or stained. Obviously, the fact that a particular block has a distinctive color will make it easier for the recipient/reconstructor to recognize that block and, therefore, to replicate the structure that is being or has been erected by the communicator/constructor. Thus, if the game is being used as a test of basic skills, or if children are being tested, it may be advisable that all of the blocks be stained different colors. The greater the degree of difficulty that is conceived, the less color will be used with the blocks. Moreover, it will be more difficult to replicate the structure being erected by one player if certain of the blocks are similar in shape, but still different from each other. Thus, providing five-sided blocks that are triangular in cross-section where the widest angle differs succinctly between 90° and 135° would be appropriate for an advanced test, because the difficulty of the communicator/constructor in defining the angles of such a block will be greater than if he can simply point out that the block in cross-section is an isosceles, equilateral, or right triangle.

Finally, after the communicator/constructor has conveyed by oral means only to his back-to-back partner what structure he is erecting or has already erected, a comparison of the two structures is made. How well the recipient/reconstructor has managed to follow the verbal, i.e., oral or written instructions of the communicator/constructor, will be indicated by how closely the two structures conform to each other. The highest degree of communicative and cognitive skills will be evidenced when the two structures are identical and that may be a difficult challenge when the blocks are all of the same color and various blocks are of the same general size and shape, differing only in small degrees with regard to such size and shape. However, while fairly miniscule differences can be used when scientific tests are being performed in order to gauge the degree of skill of the participants, when the game is used as a parlor game the degree of difficulty is contemplated to be far less, because those who are not particularly skilled in the game may still have a difficult time replicating the other's construct despite the oral communications given.

While my invention has been described with reference to a preferred embodiment, it will be apparent to those of skill in this art that various, obvious modifications and alterations may be made in that preferred embodiment without departing from the spirit of my invention. As to all such modifications and alterations, it is desired that they be included within the purview of my invention, which is to be limited only by the scope, including equivalents, of the following, appended claims.

I claim:

1. A method of playing a game testing the communicative skills of a communicator/constructor player and the cognitive skills of a recipient/reconstructor player, comprising:

positioning said players so that they are back-to-back and neither can see the acts of another in forming a construct, but said communicator/constructor player is in audible communication with said recipient/reconstructor player, providing identical groups of blocks to each of said players, said blocks being of various sizes and shapes, and including cubes, hexahedrons, cylinders, and pentahedrons, having said communicator/constructor player arrange the blocks in his possession with respect to each other and, during or at the termination of said arrangement, having said communicator/constructor player orally communicate the resulting construct to said recipient/reconstructor player, said recipient/reconstructor player attempting to duplicate said construct solely from the communication orally provided by said communicator/constructor player, and comparing said arrangements of said two players to determine how well said constructs match.

2. A method of playing a game as claimed in claim 1, in which said blocks are of varying sizes and shapes.

3. A method of playing a game as claimed in claim 2, in which said blocks are solid and formed from wood.

4. A method of playing a game as claimed in claim 3, in which said blocks are in the shape of hexahedrons, cylinders, and cubes, as well as other shapes.

5. A method of playing a game as claimed in claim 3, in which said blocks in cross-section are in the form of squares, rectangles, circles, and triangles.

6. A method of playing a game as claimed in claim 1, in which each of said players is provided with a playing board upon which said construct of blocks is assembled.

7. A method of playing a game as claimed in claim 1, in which said blocks are of different colors.

* * * * *